United States Patent [19]

Reimche

[11] Patent Number: 4,701,122

[45] Date of Patent: Oct. 20, 1987

[54] PRESSING TOOL FOR PRODUCING DISH-SHAPED PRESSED OBJECTS, IN PARTICULAR PLATES, CUPS, BOWLS, ETC., OF POWDERS, PREFERABLY CERAMIC MATERIAL

[75] Inventor: Heinrich Reimche, Garmisch-Partenkirchen, Fed. Rep. of Germany

[73] Assignee: Dorst Maschinen- und Analagenbau, Otto Dorst und Dipl.-Ing. Walter Schlegel GmbH & Co., Fed. Rep. of Germany

[21] Appl. No.: 845,449

[22] Filed: Mar. 28, 1986

[30] Foreign Application Priority Data

Apr. 10, 1985 [DE] Fed. Rep. of Germany ..... 3512852

[51] Int. Cl.[4] ..... B28B 7/00

[52] U.S. Cl. ..... 425/584; 425/405 R; 425/412

[58] Field of Search ..... 425/406, 412, 405 R, 425/417, 440, 584, 256

[56] References Cited

U.S. PATENT DOCUMENTS 4,518,341 5/1985 Suffa ..... 425/412

FOREIGN PATENT DOCUMENTS 3101236 1/1982 Fed. Rep. of Germany .
3144678 5/1983 Fed. Rep. of Germany .
2108898 5/1983 United Kingdom ..... 425/584
2109742 6/1983 United Kingdom ..... 425/584

*Primary Examiner*—Willard E. Hoag
*Attorney, Agent, or Firm*—Reese Taylor

[57] ABSTRACT

A pressing tool for producing dish-shaped pressed objects, in particular plates, cups, bowls, etc., of powdery, preferably ceramic material, comprising a die and a counterdie whose front surfaces facing each other form the upper and lower sides of the dish-shaped pressed object when the powdery material filled in therebetween is pressed, the die and the counterdie being adapted to move toward each other and the powdery material being filled into a space limited by the front surfaces of the die and counterdie and an annular element having a connection for the feeding of material, said element being displaceable relative to the die and counterdie in their direction of movement toward each other, and at least one of the rims of the front surfaces of the die and counterdie protruding in an annular shape toward the rim of the other front surface, and the die and counterdie being adapted to move toward each other only so far as to leave a small axial annular gap between the rims of their front surfaces, wherein the axially protruding annular rim is supported on the corresponding die by an axially directed outer projection on which the annular element is displaceable which has at least one vacuum connection.

7 Claims, 4 Drawing Figures

FIG. 1A

PRESSING TOOL FOR PRODUCING DISH-SHAPED PRESSED OBJECTS, IN PARTICULAR PLATES, CUPS, BOWLS, ETC., OF POWDERS, PREFERABLY CERAMIC MATERIAL

RELATED APPLICATIONS

This application claims priority under 35 U.S.C. 119 based on Federal Republic of Germany application P 35 12 852.6 filed Apr. 10, 1985.

BACKGROUND OF THE INVENTION

The present invention relates to a pressing tool for producing dish-shaped pressed objects, in particular plates, cups, bowls, etc., of powdery, preferably ceramic material, comprising a die and a counterdie whose front surfaces facing each other form the upper and lower sides of the dish-shaped pressed object when the powdery material filled in therebetween is pressed, the die and counterdie being adapted to move toward each other and the powdery material being filled into a space limited by the front surfaces of the die and counterdie and an annular element having a connection for the feeding of material, said element being displaceable relative to the die and counterdie in their direction of movement toward each other, and at least one of the rims of the front surfaces of the die and counterdie protruding in an annular shape toward the rim of the other front surface, and the die and counterdie being adapted to move toward each other only so far as to leave a small axial annular gap between the rims of their front surfaces.

Such a pressing tool is disclosed in EU Pat. No. 0 043 019. The material to be pressed is filled in by aid of gravity in the case of this pressing tool. Due to the relatively small filling slot, the filling process is relatively slow. In the case of parts having steep walls, vertical walls and/or walls with a relief structure, there is a danger of the filling process being interrupted, or at least being uneven, because the effect of gravity is partly balanced out by the frictional forces acting on the material being filled.

The invention is based on the problem of redesigning the known pressing tool so as to make it possible to fill in material by aid of underpressure applied to the filling space. However, the advantage of the known teaching must be retained, i.e. that deficient pressed objects due to deficiencies in the filling process are avoided and reworking can also be dispensed with because the pressed object directly obtained is a formation having rounded rims.

Filling by aid of underpressure or a vacuum is actually already part of prior art. According to German Pat. No. 31 01 236, filling is effected by adding the material to be pressed within the limits of the rim of the die-formed part. This means that marking in the area where material is filled in can basically not be avoided, so that one is forced to replace the filling head by a smooth-rimmed pressing head or to remove the pressed on markings again by elaborate reworking.

It is also already disclosed in German offenlegungsschrift No. 31 44 678 to effect the filling from the rim. But the displaceable annular element is a shaping element here and must therefore be designed in a way corresponding to the desired rim of the plate.

It is further disclosed in German offenlegungsschrift No. 31 26 155 to fill the press via a vacuum pipe opening out in the filling area out of a funnel surrounding this assembly. However, this is in practice gravimetric filling into a closed space, which does not ensure even filling since the corresponding closing elements must be closed at the same time. Furthermore, predosing is required, which does not ensure suction through the vacuum channels.

SUMMARY OF THE INVENTION

All of the deficiencies of the prior art can be eliminated and the problem posed solved according to the invention by the following features: in a pressing tool of the type mentioned at the outset, the protruding annular rim is supported by an axially directed outer projection on the die or counterdie on which the annular element is displaceable which has at least one vacuum connection.

This assembly makes it possible to produce pressed objects similar to those obtained by the pressing tool according to EU Pat. No. 0 043 019, which have virtually no marks but instead a rounded outer rim, so that no long and expensive reworking is required. Furthermore, the principle of vacuum filling is now made possible for the pressing tool found in this literature source without the deficiencies occurring which must be feared in the case of the other known pressing tools.

In order to rule out as much as possible the filling material being sucked off, the vacuum connection is staggered (i.e. displaced in axial direction) with respect to the annular gap in a further embodiment of the invention and connected with said annular gap via an annular clearance between the outer rims of the die and counterdie and the annular element.

OF THE DRAWINGS

BRIEF DESCRIPTION OF THE PREFERRED EMBODIMENT

Figure 1:
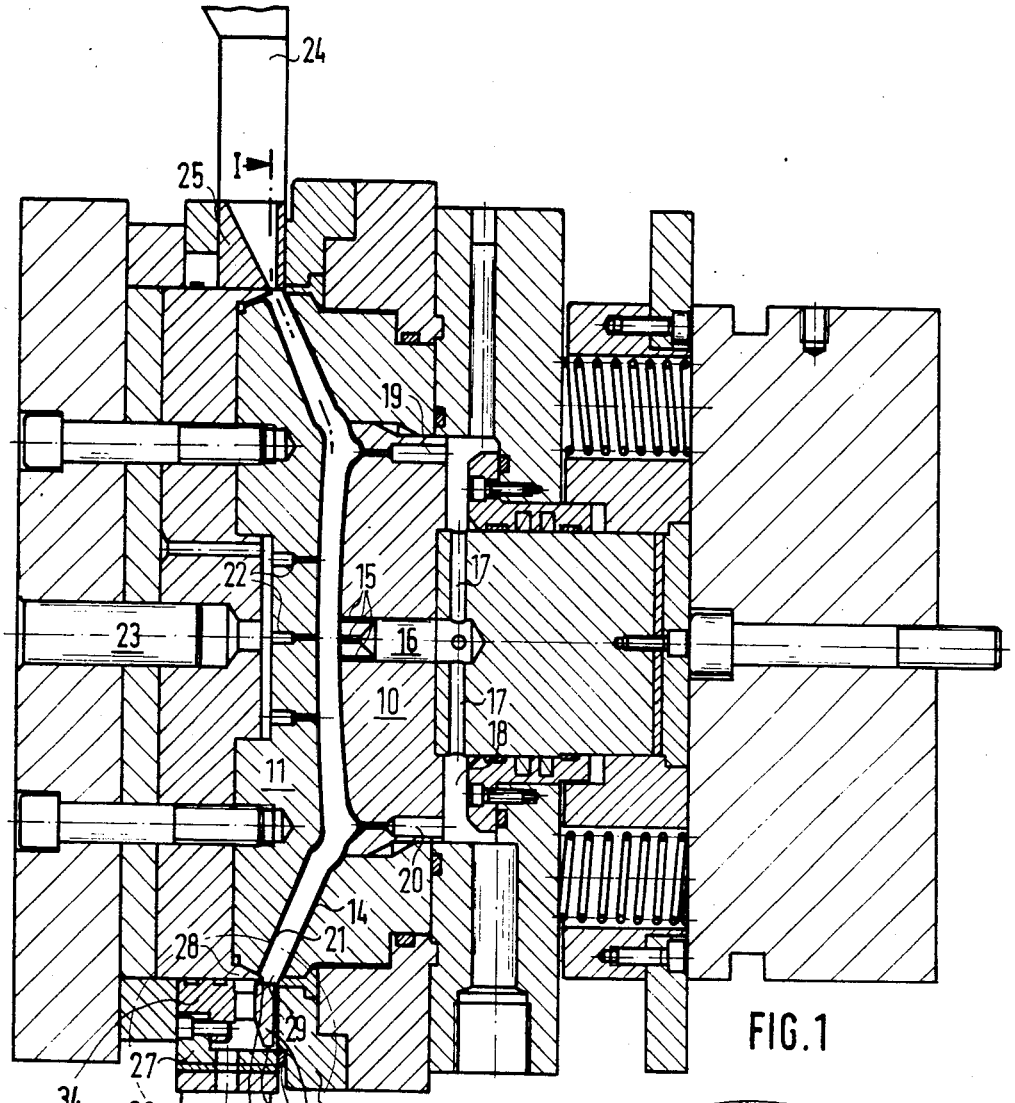
FIG. 1 shows a longitudinal section of the pressing tool according to the invention.
Figure 1A:
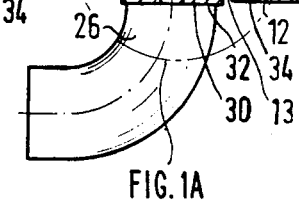
FIG. 1A is an enlarged fragmentary cross-section of the pressing tool depicted in FIG. 1, showing the construction thereof in greater detail.
Figure 1A:
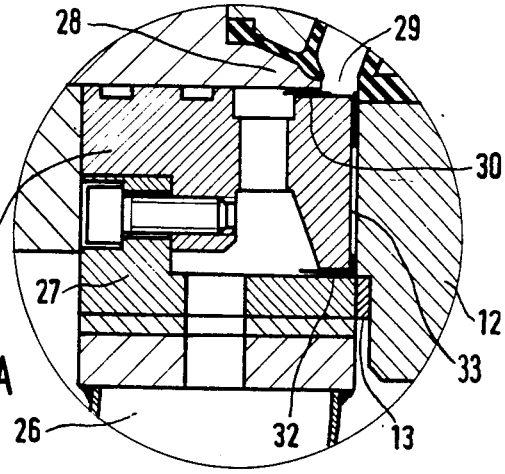

The pressing tool shown in the figures serves the purpose of producing plates from powdery ceramic material. The pressing tool contains a die 10, a counterdie 11 and a supporting ring 12 surrounding die 10. Supporting ring 12 is displaceable relative to dies 10 and 11 in the direction of movement of the two dies. Corresponding to FIG. 1, supporting ring 12 lies in the filling position against a sealing ring 13 which effects a vacuum-tight seal with respect to the outside. The mechanism for moving the supporting ring is irrelevant here, so that it is not recorded in the drawings. The front side of die 10 forms the underside of the plate and is covered by an elastic rubber coating 14 behind which channels 15 open out. These channels 15 communicate via a channel 16 and channels 17 with an annular channel 18 which can be subjected to a pressure medium. Further branch pipes can be seen at 19 and 20. Die 11 is also covered by a rubber cover 21 behind which channels 22 open out which can be fed by a central channel 23. Die 11 can thus be pressurized from the outside, which makes it possible to detach the formed plate more easily from die 11 or its rubber cover 21 when dies 10 and 11 have moved apart again.

Figure 2:
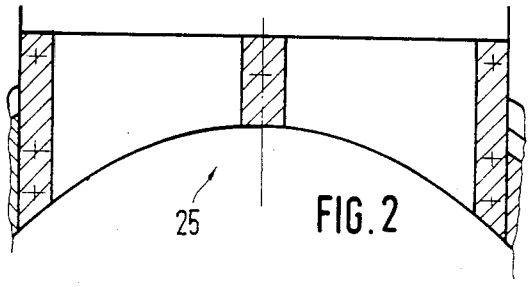
FIG. 2 shows a section substantially on the plane of arrow I in FIG. 1.
Figure 3:
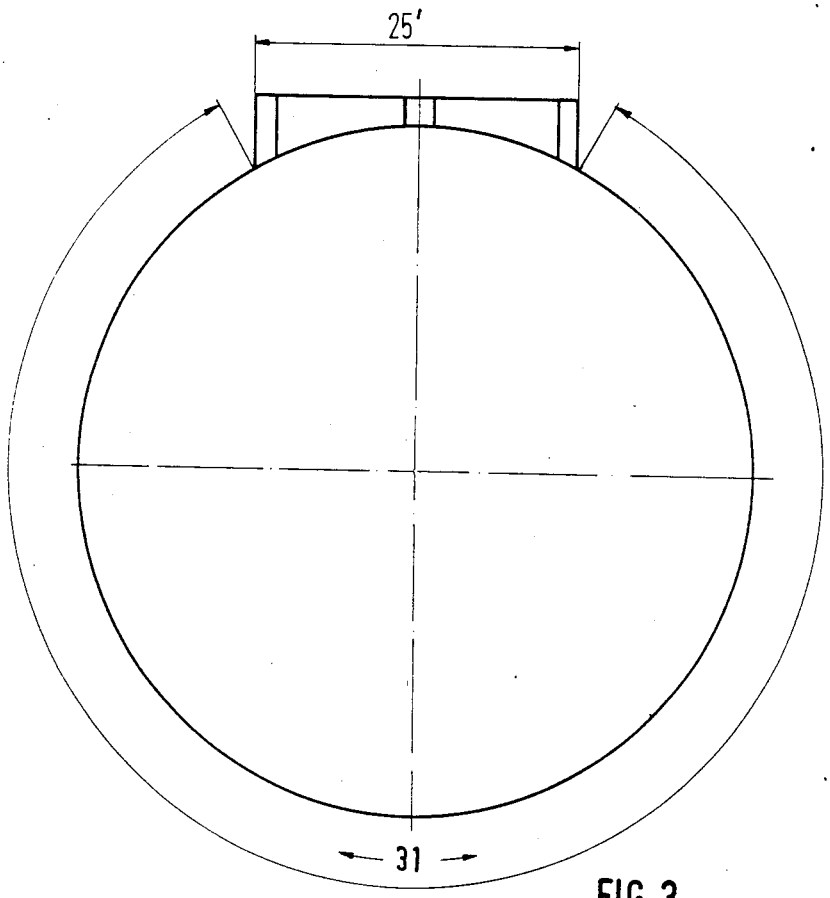
FIG. 3 is a schematic view of the peripheral slot for the suction device.

The filling of the space between dies 10 and 11 is effectuated by aid of a funnel 24 which can be placed on a filling element 25 of an annular element 27. This filling element 25 is shown in more detail in FIG. 2. It covers the space which is indicated as 25' in FIG. 3 and is inserted as a segment-like element in annular element 27.

In the portion of annular element 27 on the bottom of FIG. 1 a vacuum connection with a suction pipe 26 is attached via a connecting piece 34 which is disposed opposite the limit of the element in the shape of protruding annular rim 28 lining the back of the rim area of membrane 21. Suction pipe 26, as is clearly shown in FIG. 1, is staggered axially with respect to an axial annular gap 29 remaining on the rim of counterdie 11 and die 10 when the pressing tool is closed, and connected with this annular gap 29 via an annular clearance. This annular clearance is formed according to FIG. 1 by a radial gap 30 between the outer rim of the corresponding die 11 and the adjacent inner rim of annular element 27 which connects suction pipe 26 with axial annular gap 29. The radial and axial annular gaps 30 and 29 extend according to FIG. 3 over the area indicated by the round arrow 31. The forming material is thus supplied in area 25' and the air sucked out of the space between dies 10 and 11 via area 31.

FIG. 1 indicates that axial annular gap 29 can be connected with the suction pipe via a further radial annular gap 32. This radial annular gap 32 continues via an axial annular slot 33 between annular element 27 and supporting ring 12 into axial annular gap 29.

While a full and complete description of the invention has been set forth in accordance with the dictates of the patent statutes, it should be understood that modifications can be resorted to without departing from the spirit hereof or the scope of the appended claims.

What is claimed is:

1. A pressing tool for producing dish-shaped pressed objects of powdery material, including a die and a counterdie whose front surfaces facing each other form the upper and lower sides of the dish-shaped pressed object when the powdery material filled in therebetween is pressed, the die and the counterdie being adapted to move toward each other comprising: an annular element supported on the die or counterdie and the powdery material being filled into a space limited by the front surfaces of the die and counterdie, said annular element having a connection for the feeding of material and at least one vacuum connection means, and said annular element being displaceable relative to the die and counterdie in their direction of movement toward each other, and at least one of the rims of the front surfaces of the die and counterdie protruding in an annular shape toward the rim of the other front surface, and the die and counterdie being adapted to move toward each other only so far as to leave a small axial annular gap between the rims of their front surfaces, wherein the axially protruding annular rim is supported on the corresponding die by an axially directed outer projection on which the annular element is displaceable; said vacuum connection means being axially offset with respect to an axial annular gap defined on the rim of the die and counterdie when the pressing tool is closed; and said vacuum connection further being in communication with said annular gap via at least one annular clearance.

2. The pressing tool according to claim 1, wherein the vacuum connection and the connection for the feeding of material are arranged opposite each other.

3. The pressing tool according to claims 1 or 2, wherein the connection for the feeding of material comprises an inserted element adapted to be inserted into the annular element and provided with at least one funnel tube.

4. The pressing tool according to claims 1 or 2, wherein the vacuum connection means is in connection with the axial annular gap by a radial annular gap between the outer rim of the outer projection and the inner rim of the annular element adjacent thereto.

5. The pressing tool according to claim 3, wherein the vacuum connection means is in connection with the axial annular gap through a radial annular gap between the outer rim of the outer projection and the inner rim of the annular element adjacent thereto.

6. The pressing tool according to claims 1 or 2, further comprising a supporting ring surrounding at least one of the dies in opposition to the annular element, wherein the vacuum connection means is in communication with the axial annular gap through an axial annular slot between the annular element and the supporting ring and a radial annular gap joined to the axial annular slot.

7. The pressing tool according to claim 5 further comprising a supporting ring surrounding at least one of the dies in opposition to the annular element, wherein the vacuum connection means is in communication with the axial annular gap through an axial annular slot between the annular element and the supporting ring and a radial annular gap joined to the axial annular slot.

* * * * *